US007238148B2

(12) United States Patent
Simmons

(10) Patent No.: US 7,238,148 B2
(45) Date of Patent: Jul. 3, 2007

(54) FORCE SWING EXERCISE APPARATUS

(76) Inventor: Louis J. Simmons, 3884 Larchmere Dr., Grove City, OH (US) 43123

( * ) Notice: Subject to any disclaimer, the term of this patent is extended or adjusted under 35 U.S.C. 154(b) by 175 days.

(21) Appl. No.: 10/852,445

(22) Filed: May 24, 2004

(65) Prior Publication Data

US 2005/0272576 A1 Dec. 8, 2005

(51) Int. Cl.
*A63B 21/04* (2006.01)
*A63B 21/068* (2006.01)
*A63G 9/00* (2006.01)

(52) U.S. Cl. ..... 482/130; 482/95; 482/128; 482/143; 472/118

(58) Field of Classification Search ..... 482/142, 482/133, 51, 143, 145, 121–3, 72, 137, 129, 482/97–100, 95, 135, 130, 96, 128; 472/118, 472/120–1, 119, 124–5; 297/277, 280, 259.3–259.4, 297/260.3
See application file for complete search history.

(56) References Cited

U.S. PATENT DOCUMENTS

| | | | | | |
|---|---|---|---|---|---|
| 886,974 | A * | 5/1908 | Hathaway | 297/78 |
| 2,682,401 | A * | 6/1954 | Perry | 482/96 |
| 2,827,950 | A * | 3/1958 | Carden | 472/124 |
| 3,171,653 | A * | 3/1965 | Pacuk | 472/120 |
| 3,586,322 | A * | 6/1971 | Kverneland | 482/72 |
| 4,511,137 | A * | 4/1985 | Jones | 482/100 |
| 4,678,187 | A * | 7/1987 | Prsala | 482/130 |
| 4,747,594 | A * | 5/1988 | Houde | 482/72 |
| 5,106,080 | A * | 4/1992 | Jones | 482/97 |
| 5,370,594 | A | 12/1994 | Grinblat | |
| 5,429,568 | A * | 7/1995 | Chen | 482/96 |
| 5,603,678 | A * | 2/1997 | Wilson | 482/97 |
| 5,626,548 | A * | 5/1997 | Coyle | 482/137 |
| 5,674,167 | A | 10/1997 | Piaget et al. | |
| 5,722,917 | A | 3/1998 | Olschansky et al. | |
| 5,827,158 | A * | 10/1998 | Drecksel | 482/96 |
| 5,897,462 | A | 4/1999 | St. Germain | |
| 5,921,900 | A | 7/1999 | Mankovitz | |
| 6,605,024 | B2 * | 8/2003 | Stearns | 482/142 |
| 6,676,577 | B2 * | 1/2004 | Stearns | 482/142 |
| 2002/0123414 | A1 | 9/2002 | Chen | |

* cited by examiner

*Primary Examiner*—Stephen R. Crow
*Assistant Examiner*—Allana Lewin
(74) *Attorney, Agent, or Firm*—John A. THomas

(57) ABSTRACT

An exercise apparatus comprises a frame having a base and an apex. A least one pivot is connected to the frame for supporting a swinging arm. The opposite end of the arm supports a seat for an exercising athlete, and optional weights. The frame supports a force plate opposed to the seat. The seat and the force plate are connected by elastic members, such as bands, that bias the seat toward the force plate. The athlete develops reversal strength by extending his legs to bound from the force plate, then stopping the resulting forward motion at a predetermined joint position before rebounding again.

7 Claims, 4 Drawing Sheets

FORCE SWING EXERCISE APPARATUS

FIELD OF THE INVENTION

The invention relates to the field of strength training, specifically to strength training intended to increase reversal, or explosive strength.

BACKGROUND

Absolute muscle strength is one goal of a strength-training program, of course. Other training goals are also important, such as endurance, flexibility, and speed. In particular, development of explosive strength, or jumping ability, is important for all sports. This ability is not well developed with conventional peak-contraction training, which keeps continuous tension on the fully contracted muscle. Another training goal, especially for sports, is to overcome the so-called bilateral deficit. The bilateral deficit is the difference between the maximal effort that can be developed with one arm (or leg) and two arms (or legs) working together. For example, persons generally cannot exert a force during a two-arm effort that is twice that of the one-arm maximal effort.

Plyometric training is the field of strength training intended to increase the reversal strength of subjects. Plyometric training achieves its effects by taking advantage of the energy stored in contracted muscle. Such training can also be used to train individuals to overcome the bilateral deficit.

A muscle develops its maximum force during a rapid eccentric contraction. An "eccentric contraction" occurs when a muscle is forced to lengthen due to the high external load, although it may be fully activated. "Contraction" in this context does not necessarily imply shortening. Contractions that permit the muscle to shorten are referred to as "concentric contractions." In concentric contractions, the force generated by the muscle is always less than the muscle's maximum. Of course, muscles seldom perform one type of contraction in isolation during athletic movements.

If a muscle is stretched, energy is stored by the elastic components of the muscle. This stored energy is available to the muscle only during a later contraction. When a concentric contraction occurs immediately following an eccentric contraction, then the force generated can be dramatically increased. This increase in force is lost if the eccentric contraction is not followed immediately by a concentric effort. To express this greater force the muscle must contract within the shortest time possible. This whole process is frequently called the stretch shortening cycle and is the underlying mechanism of plyometric training. Plyometric training places increased stretch loads on the working muscles. As the muscles become more tolerant to the increased loads, the stretch-shortening cycle becomes more efficient.

Prior-art training machines are primarily devoted to developing high strength through the peak-contraction principle. There is a need for a training apparatus that will allow athletes who are already strong to develop reversal strength, especially through a large range of motion.

SUMMARY

The preferred embodiment of the invention comprises a frame having a base and an apex. A least one pivot is connected to the frame for supporting a swinging arm. The opposite end of the arm supports a seat for an exercising athlete, and optional weights. The frame supports a force plate opposed to the seat. The seat and the force plate are connected by elastic members, such as bands, that bias the seat toward the force plate. The athlete develops reversal strength by extending his legs to bound from the force plate, then stopping the resulting forward motion at a predetermined joint position before rebounding again. An arm force plate is also provided for arm exercises.

DRAWINGS

DETAILED DESCRIPTION

Figure 1:
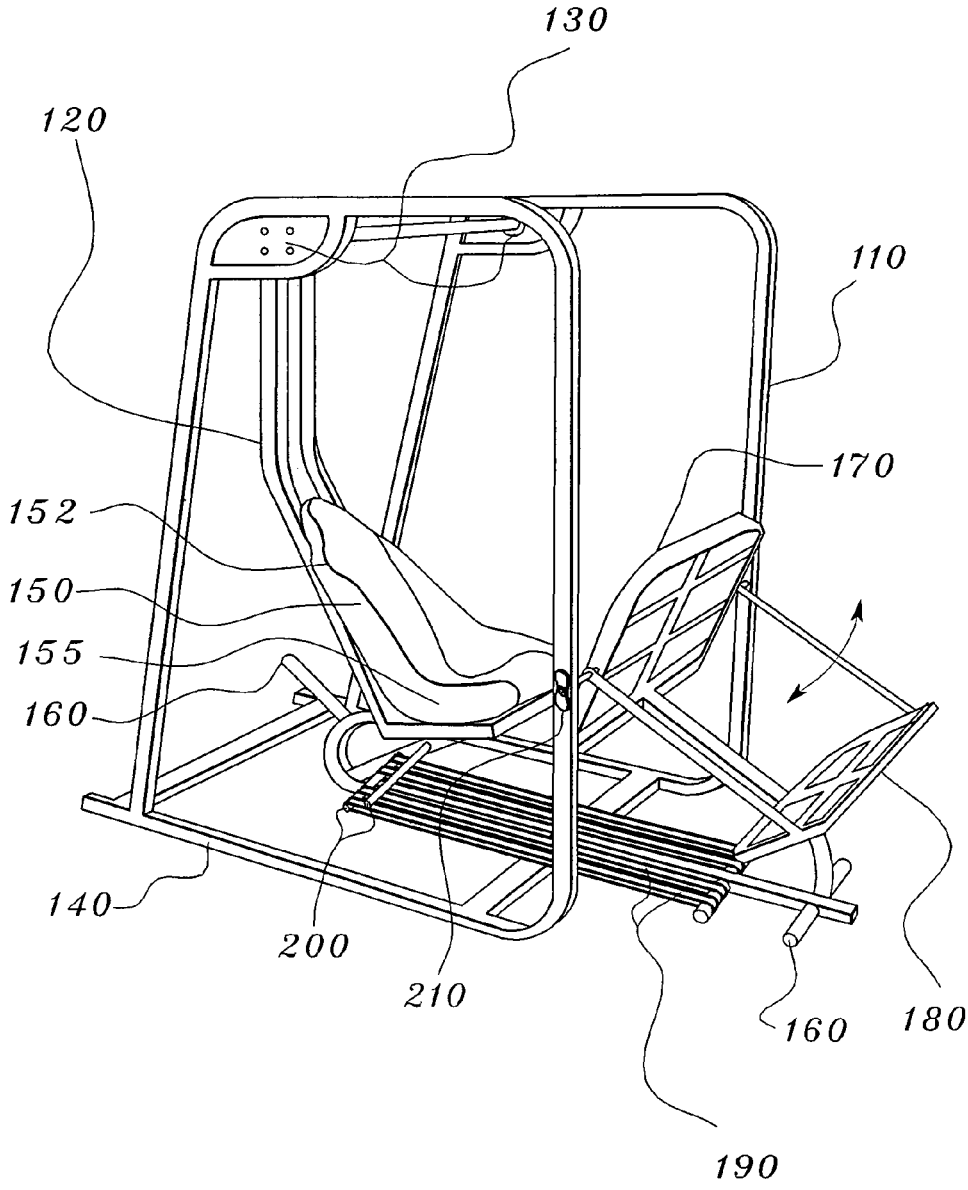
FIG. 1 is a perspective view of an embodiment of the invention.

FIG. 1 shows a perspective view of an embodiment of the invention. The apparatus of the preferred embodiment has a frame (110). The frame (110) has a pivoting arm (120) supported at the apex of the frame (110) by pivot bearings (130). The frame (110) preferably has a base (140) for strength and stability. A seat (150) is attached to the end of the pivoting arm (120) opposite the bearing (130), so that the athlete can swing back and forth in the frame (110). The seat has a back portion (152) and a bottom portion (155). The back portion (152) and the bottom portion (155) are disposed to one another at an angle of approximately 90 degrees, so that the full weight of the athlete (100) may be supported in all positions. The seat (150) may have additional weights (not shown) mounted to it on one or more weight pegs (160), to increase the forces generated during the exercise.

Initially, the feet of the athlete rest against a leg force plate (170).

An arm force plate (180) is mounted opposite to the leg force plate (170), and rotatable into position if arm exercises are desired. The following description illustrates the use of the apparatus with the leg muscles, but similar movements will be made for use with the arms. The positions of the leg force plate (170) and the arm force plate (180) are preferably made adjustable by a screw and handle (210), so that the apparatus can be switched between leg and arm exercises.

One or more elastic members (190) are connected between the frame (110) and the seat (150), as shown in the figures. In the initial position of the exercise, the members (190) are relaxed. The reader should note that the "members" described in this disclosure are preferably bands of an elastic material, such as a synthetic rubber, but they may also be springs. A suitable band is the JUMP STRETCH band, manufactured by Jump Stretch, Inc., of Youngstown, Ohio. The bands (190) connect to the seat (150) with band adjustment pegs (200) at different positions, so that the tension they exert during the exercise may be varied.

Figure 2:
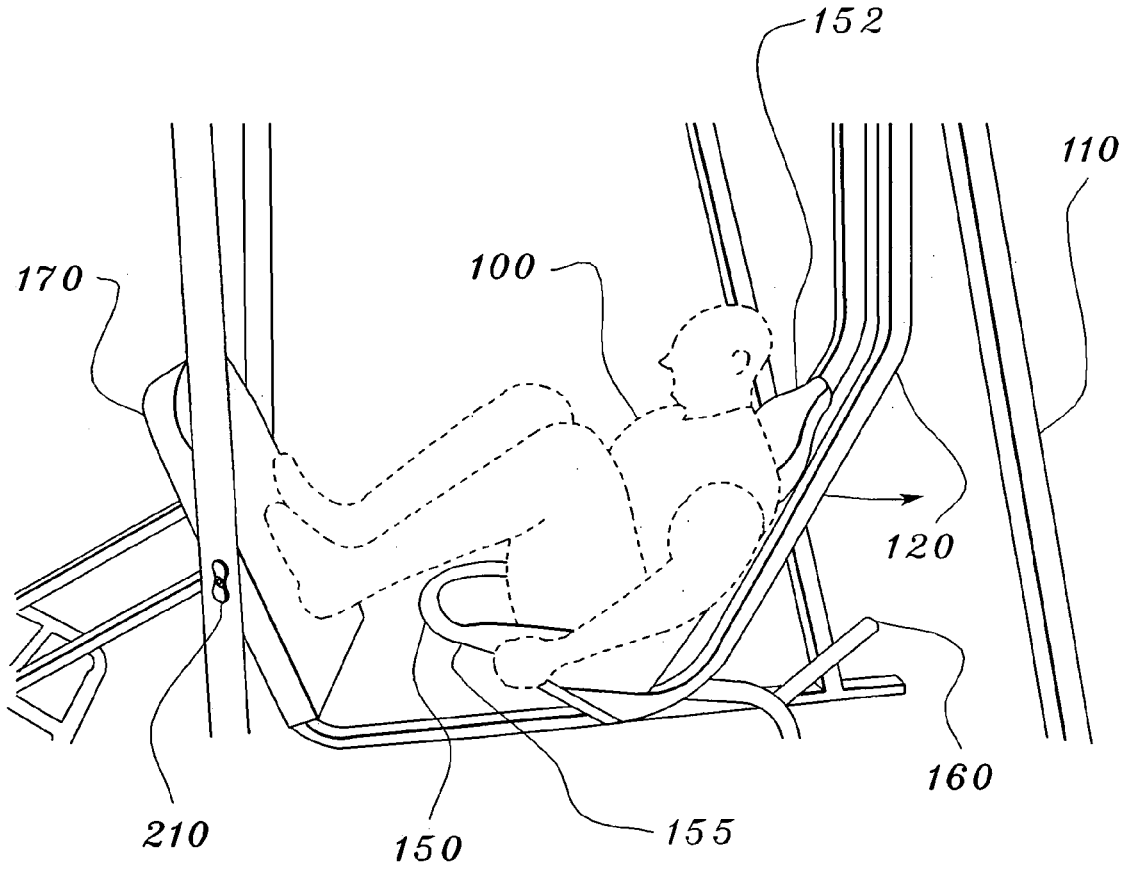
FIG. 2 is a side view of an embodiment of the invention, showing an athlete in a starting position for leg exercise.

FIG. 2 shows the athlete (100) in the initial position of the exercise, with his legs cocked. The seat (150) and thus the athlete (100) are pulled toward the force plate (170) by the restoring force of the bands (190).

Figure 3:
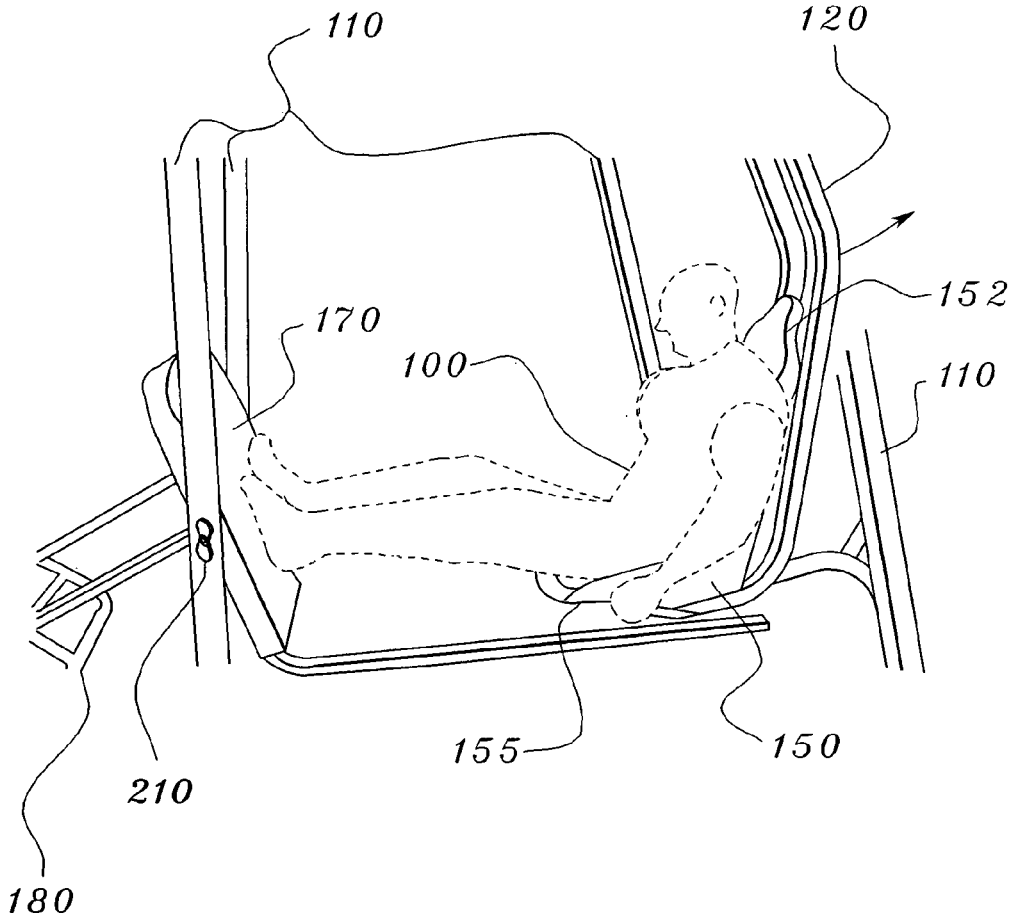
FIG. 3 is a side view of the embodiment showing an athlete in a fully-extended position for a reversal-strength exercise of the legs.

FIG. 3 shows the athlete (100) and the apparatus in the fully extended position. The athlete (100) has arrived at this position by pushing away from the force plate (170) with his leg muscles. On doing so, the bands (190) are stretched, generating a force tending to restore the seat (150) to its original position, according to Hooke's law:

$$F=-kx$$

where F is the restoring force exerted by the elastic material, x is the displacement, and k is the "spring constant" of the elastic material. The athlete may, with sufficient initial force, push his body to the position shown in FIG. 3, where his feet have disengaged from the force plate (170), and the seat (150) has risen above its initial level because of the pivoting of the arm (120). In this position, the energy stored in the extended bands (190) is augmented by the gravitational potential energy of the raised athlete (100), seat (150), and any additional weights (160). These potential energies will then be released as kinetic energy to propel the athlete (100) rapidly back toward the force plate (170).

The athlete (100) completes the exercise cycle by stopping the forward motion of his body against the force plate (170) at the joint position he desires for any particular training goal. For example, the athlete (100) may exert his leg muscles to stop the forward movement of this body at the initial position, or at some greater or lesser distance from the force plate.

When the athlete (100) thus stops his forward motion, and then pushes back, his muscles exert a concentric contraction to push back, immediately following the eccentric contraction necessitated by stopping his forward motion while his muscles are extended. This immediate concentric contraction achieves the goal of increasing muscle tolerance to increased loads and developing explosive strength.

Figure 4:
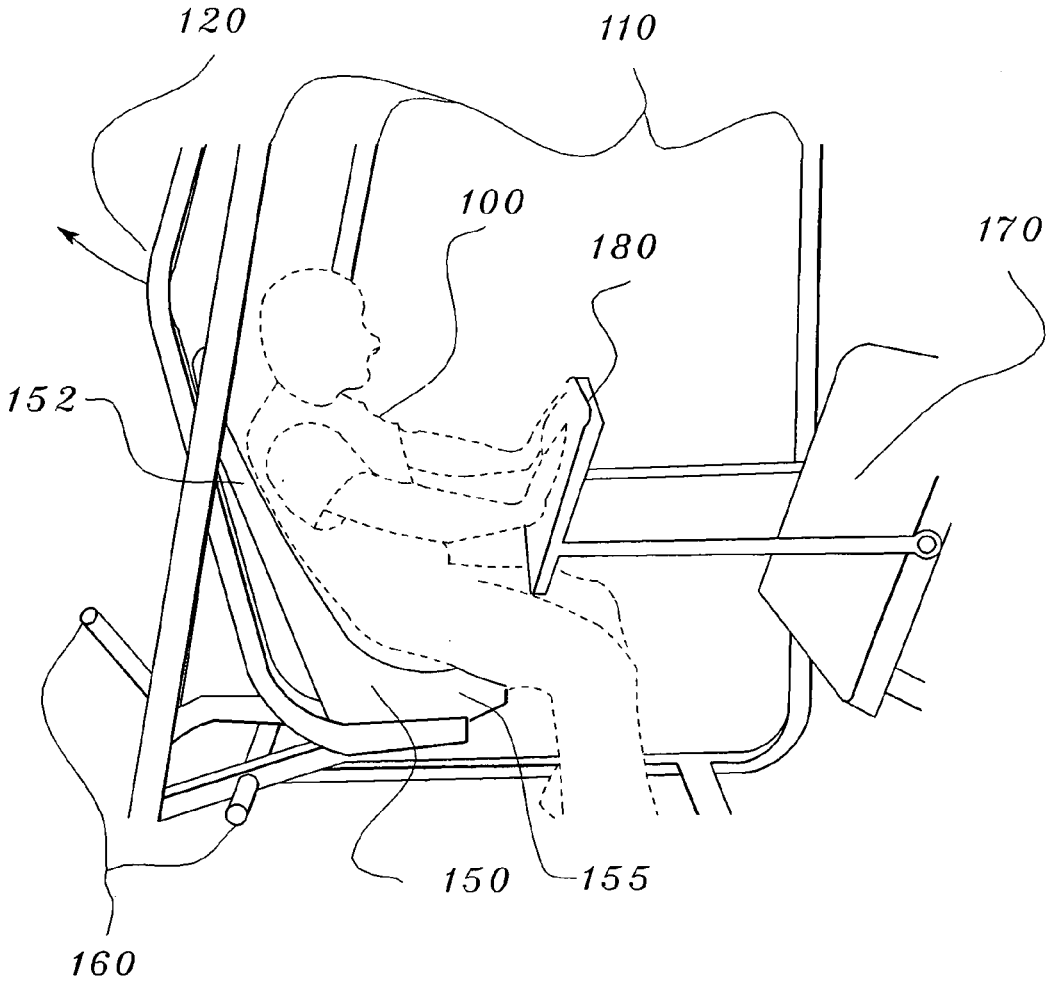
FIG. 4 is a side view of the embodiment showing an athlete in the starting position for arm exercise.

Similar movements are possible using the arms against the arm force plate (180). The starting position for arm exercises is shown in FIG. 4. The athlete (100) pushes back, then is propelled forward, and brakes his motion against the arm force plate (180) in the desired joint position before rebounding to repeat the exercise. The arm force plate (180) is of course rotated into position and locked before the exercise.

The athlete (100) may train to overcome the bilateral deficit by using only one arm or leg during the exercises.

Since those skilled in the art can modify the specific embodiments described above, I intend that the claims be interpreted to cover such modifications and equivalents.

I claim:

1. An exercise apparatus comprising:

a frame;

at least one pivot; the pivot connected to the frame;

at least one arm; the arm having a first end and a second end;

the first end of the arm connected to the pivot;

a seat for supporting a person exercising, the seat connected to the second end of the arm;

the seat disposed below the pivot;

the seat having a back portion for supporting the person's back and a bottom portion for supporting the person's buttocks;

the seat disposed with respect to the arm so that the person is faced away from the pivot;

at least one rotatable force plate opposing the seat; the force plate connected to the frame; and, at least one elastic member connected between the seat and the frame, so as to bias the seat toward the force plate.

2. The apparatus of claim 1 above comprising two or more elastic members.

3. The apparatus of claim 1 above where the elastic member is a spring.

4. The apparatus of claim 1 above where the seat further comprises a peg for securing weights.

5. The apparatus of claim 1 above further comprising an arm force plate and a leg force plate.

6. A method of exercising a person's leg muscles to enhance reversal strength, comprising the steps of:

providing a frame;

providing at least one pivot, the pivot connected to the frame;

providing an arm; the arm having first and second ends; the first end connected to the pivot;

providing a seat for the person; the seat connected to the second end of the arm;

the seat disposed below the pivot;

the seat having a back portion for supporting the person's back and a bottom portion for supporting the person's buttocks; and, the seat disposed with respect to the arm so that the person is faced away from the pivot;

providing a rotatable force plate opposing the seat; the force plate connected to the frame;

providing an elastic member connected between the seat and the frame so as to bias the seat position toward the force plate;

pressing the person's feet against the force plate to straighten the person's legs and to propel the person away from the force plate; and, stopping the person's forward motion toward the force plate at a predetermined flexion of the person's legs.

7. A method of exercising a person's arm muscles to enhance reversal strength, comprising the steps of:

providing a frame;

providing at least one pivot, the pivot connected to the frame;

providing an arm; the arm having first and second ends; the first end connected to the pivot;

providing a seat for the person; the seat connected to the second end of the arm;

the seat disposed below the pivot;

providing a force plate opposing the seat; the force plate connected to the frame;

providing an elastic member connected between the seat and the frame so as to bias the seat position toward the force plate;

pressing the person's hands against the force plate to straighten the person's arms and propel the person away from the force plate; and, stopping the person's forward motion toward the force plate at a predetermined flexion of the person's arms.

* * * * *